United States Patent [19]

Reinke et al.

[11] 4,390,060

[45] Jun. 28, 1983

[54] AIR-CIRCULATING ASSEMBLY

[76] Inventors: Nelson A. Reinke, 10300 Cathleen Dr.; B. G. Ulch, 287 Oak St., both of Harrison, Mich. 48625

[21] Appl. No.: 285,430

[22] Filed: Jul. 20, 1981

[51] Int. Cl.[3] ..... F28F 7/00

[52] U.S. Cl. ..... 165/76; 165/DIG. 2; 165/122

[58] Field of Search ..... 165/DIG. 2, 76, 185; 126/99 A, 67, 99 AA; 34/86

[56] References Cited

U.S. PATENT DOCUMENTS 1,631,721 6/1927 Boischevalier ..... 165/DIG. 2

3,124,197 3/1964 Funk ..... 237/55 X 4,050,628 9/1977 Konnerth ..... 165/DIG. 2

4,232,732 11/1980 Johnson ..... 165/DIG. 2

*Primary Examiner*—William R. Cline

*Assistant Examiner*—Theophil W. Streule, Jr.

*Attorney, Agent, or Firm*—Harold W. Milton, Jr.

[57] ABSTRACT

An air-circulating assembly includes a motor driven fan and a shroud supporting the fan. The assembly is characterized by a support structure for extending about and engaging an existing stove pipe for removably attaching the shroud to the exterior of the stove pipe so that the fan moves ambient air past the stove pipe to heat the ambient air.

10 Claims, 4 Drawing Figures

AIR-CIRCULATING ASSEMBLY

BACKGROUND OF THE INVENTION (1) Field of the Invention

The instant invention relates to a heat saving device and, more particularly, to a fan for circulating ambient air over a warm stove pipe to more efficiently utilize the heat generated by the stove.

(2) Description of the Prior Art

In order to provide a more efficient use of a heating device in a room, assemblies have been constructed to further utilize heat that would otherwise be lost to the outside air. For example, heaters, such as wood-burning stoves, lose a great deal of heat through the stove stack pipe. Devices have been constructed for circulating ambient air over the warm pipe to heat the air and warm the surrounding room, thereby more efficiently using the stove. Various constructions have been devised for connecting the fan to the stack.

The instant invention provides a quite simple and inexpensive, yet effective means for supporting the fan on the stack.

SUMMARY OF THE INVENTION

The instant invention provides an air-circulating assembly including a fan and a shroud for supporting the fan. The assembly is characterized by a support structure for extending about and engaging an existing stove pipe for removably attaching the shroud to the exterior of the stove pipe for moving ambient air past the stove pipe to heat the ambient air from the stove pipe.

PRIOR ART STATEMENT

The U.S. Pat. No. 3,124,197 to Funk discloses a heat exchanger device including a box-like structure disposed about a hollow sleeve. The sleeve is connected between the ends of a break in a stack pipe to receive the hot flue gases therefrom. A fan is suitably mounted so that, as heat and smoke passes through the sleeve portion, the fan is operated to draw ambient air into the inlet of the box-like structure and therethrough so that the fan circulates hot air around the sleeve to be heated thereby and then force the heated air into the surrounding room. The Funk patent does not teach the means of the subject invention for maintaining the shroud support structure on the stack. More specifically, Funk does not show the use of a support structure extending about and engaging an existing stove pipe for removably attaching the fan and/or shroud thereof to the exterior of the stove pipe.

BRIEF DESCRIPTION OF THE DRAWING

Other advantages of the present invention will be readily appreciated as the same becomes better understood by reference to the following detailed description when considered in connection with the accompanying drawings wherein.

DESCRIPTION OF PREFERRED EMBODIMENTS

An air-circulating assembly constructed in accordance with the instant invention is generally shown at 10.

The instant invention generally includes a fan assembly, generally indicated at 12 and a shroud, generally indicated at 14, for supporting the fan assembly 12. The instant invention is characterized by including support means for extending about and engaging an existing stove pipe 16 of a stove 18 for removably attaching the shroud 14 to the exterior of the stove pipe 16 for moving ambient air past the stove pipe 16 to heat the ambient air. In other words, the fan forces air over the hot stove pipe, thereby heating the air. The fan circulates this heated air into the surrounding rooms.

Figure 4:
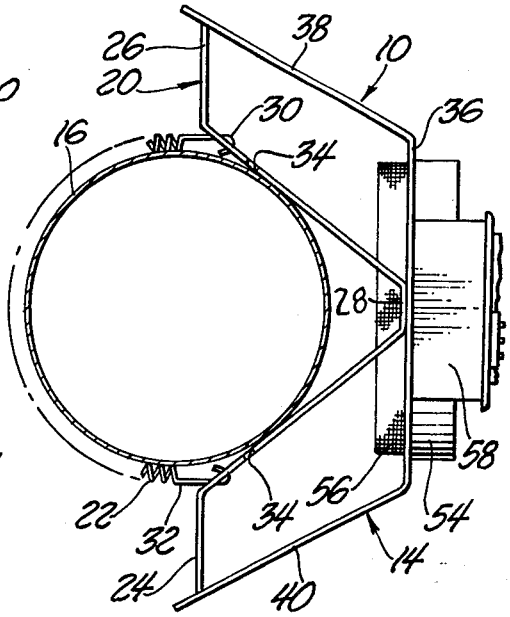
FIG. 4 is an enlarged cross-sectional view taken substantially along line 4—4 of FIG. 2.

The support means includes a cradle, generally indicated at 20, for engaging one side of the stove pipe 16 and two flexible members 22 attached to the cradle 20 and extending around the remainder of the pipe 16 to hold the cradle 20 against the pipe 16. More specifically, the cradle includes two vertically spaced substantially V-shaped members 20 having first and second end portions 24 and 26, respectively, secured to the shroud 14, as by welding and as shown in FIG. 4. A central portion 28 of each of the V-shaped members 20 is also fixedly secured to the shroud 14, as by welding.

Figure 1:
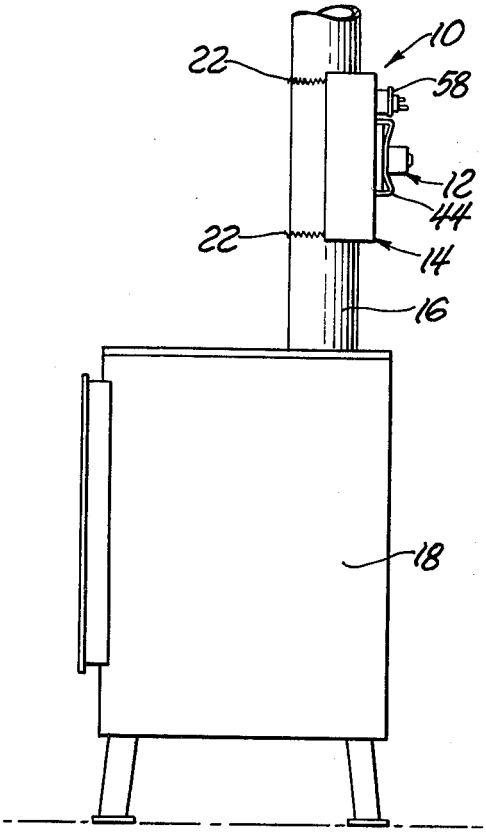
FIG. 1 is an elevational view of the instant invention removably attached the exterior of a stove pipe of a stove.
Figure 2:
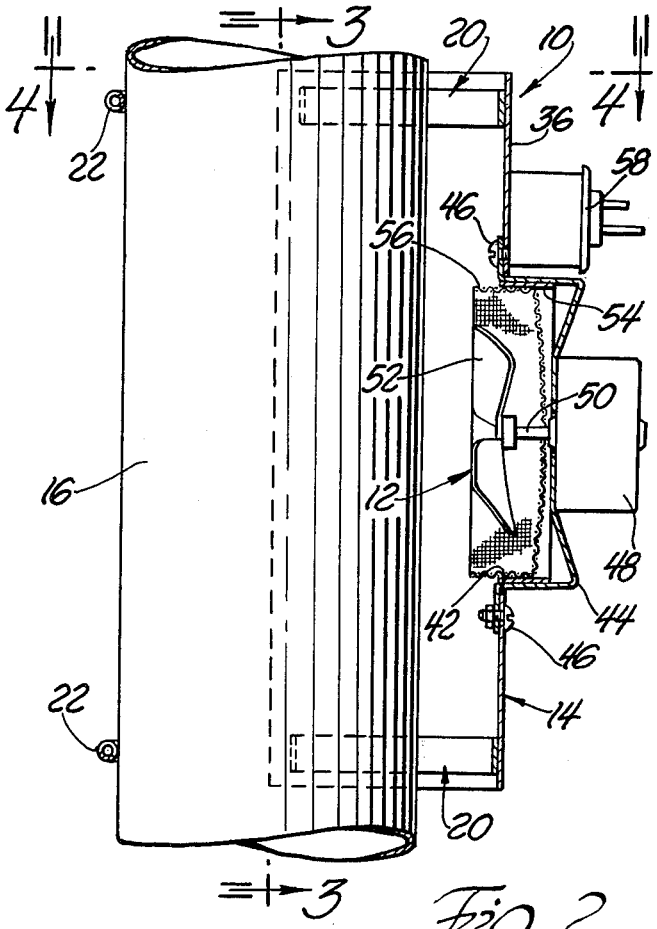
FIG. 2 is an enlarged elevational view partially in cross section of the instant invention removably attached to a stove pipe.

As shown in FIGS. 1, 2 and 4, the flexible members 22 are springs having first and second ends 30 and 32, respectively, removable connected to the first and second end portions 26 and 24 of the V-shaped members 20, respectively. More specifically, the first and second end portions 24 and 26 of the V-shaped members 20 include a plurality of holes 34 therethrough, as shown in FIG. 4. The first and second ends 30 and 32 of the springs 22 are hook-shaped so as to removably engage the V-shaped members 20 within the holes 34. The legs of the V-shaped members 20 include a plurality of holes 34 on each leg so that a single assembly constructed in accordance with the instant invention can be adapted to stove pipes having a variety of diameters. Alternatively, other types of adjustable straps can be substituted for the spring 22 and can be secured to the V-shaped member 20 by various other means.

The shroud 14 includes a central portion 36 and first and second side portions 38 and 40, respectively. The first and second side portions 38 and 40 are nonparallel in relation to the central portion 36 and are substantially symmetrical to each other. Thusly, the shroud 14 partially surrounds the stove pipe 16 thereby directing air flowing through the fan means 12 and across the stove pipe 16. Additionally, the first and second end portions 24 and 26 of the V-shaped members 20 are fixedly secured to the first and second side portions 38 and 40. In other words, the end portions 24 and 26 of the V-shaped members 20 are connected to the side portions 38 and 40 of the shroud 14 and the central portion 28 of the V-shaped member 20 is fixedly secured to the central portion 36 of the shroud 14.

Figure 3:
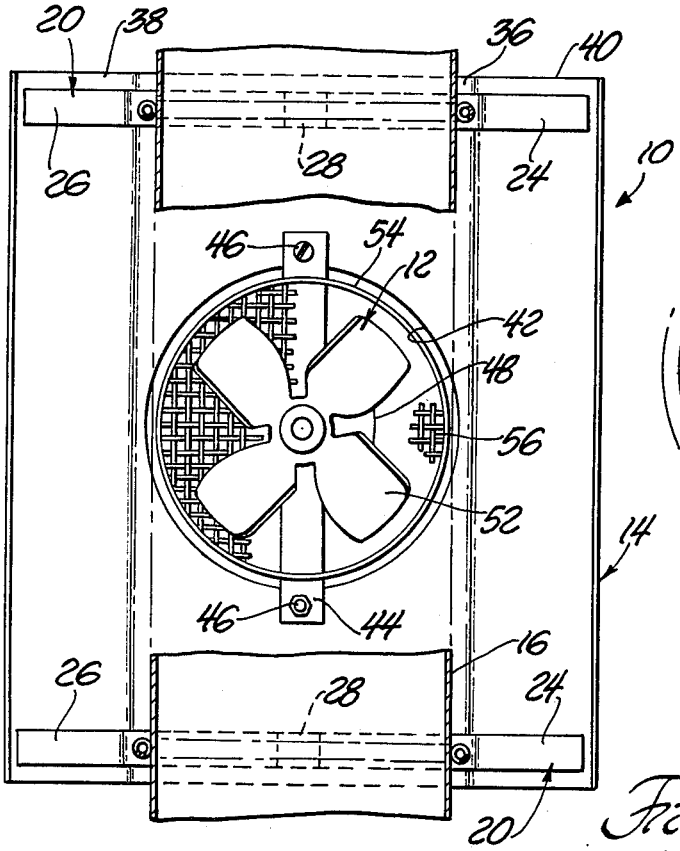
FIG. 3 is an enlarged elevational cross-sectional view taken substantially along line 3—3 of FIG. 2.

As shown in FIGS. 2 and 3, the central portion 36 includes an opening 42 therethrough. The fan assembly 12 is disposed within the opening 42. A substantially U-shaped support member 44 is connected by screws 46 to the central portion 36 of the shroud 14, the U-shaped support member 44 vertically spanning the opening 42.

The fan assembly 12 includes a direct drive motor 48, a driven shaft 50 extending from the motor 48 and a fan member 52 secured to the shaft 50. The motor 48 is secured to and supported by the U-shaped support member 44. An annular support member 54 is disposed about the opening 42 and is secured to the legs of the U-shaped support member 44. A screen 56 is disposed over the opening 42 and includes a peripheral portion about the outer circumference thereof which is connected to and is supported by the annular support member 54. The screen 56 further includes an opening therethrough, the shaft 50 extending through the opening in the screen 56.

An electrical connection 58 is provided so that the assembly can be connected to an electrical outlet near the stove 18.

In operation, the assembly is placed against a stove pipe 16 so that the substantially V-shaped members 20 engage one side of the stove pipe 16. The hooked ends 30 and 32 of the springs 22 are inserted into the holes 34 of the V-shaped members 20 so as to engage the V-shaped member 20. Thusly, a support means is provided which extends about and engages the stove pipe 16 for removably attaching the shroud 14 to the exterior of the stove pipe 16. An on-off switch is provided for actuating the fan assembly 12. Thusly, the instant invention can be quickly installed so as to circulate warm air throughout a room. The assembly does not have to be removed to clean the stove pipe 16 or chimney attached thereto and does not add to the creosote buildup. Additionally, the support means of the instant invention allows the assembly 10 to be rotated to change the direction of the circulating air. The V-shaped cradle 20 also provides a single assembly constructed in accordance with the instant invention to stove pipes having various diameters.

The instant invention has been described in an illustrative manner and it is to be understood that the terminology which has been used is intended to be in the nature of words of description rather than of limitation.

Obviously, many modifications and variations of the present invention are possible in light of the above teachings. It is, therefore, to be understood that within the scope of the appended claims wherein reference numerals are not to be in any way limiting, the invention may be practiced otherwise and as specifically described.

The embodiments of the instant invention in which an exclusive property or privilege is claimed are defined as follows:

1. An air-circulating assembly (10) comprising; fan means (12), shroud means (14) for supporting said fan means (12), and said assembly characterized by support means for extending about and engaging an existing stove pipe (16) for removably attaching said shroud means (14) to the exterior of the stove pipe (16) for moving ambient air past the stove pipe (16) to heat the ambient air from the stove pipe (16), and said support means including a cradle (20) for engaging one side of the stove pipe (16) and at least one flexible member (22) attached to said cradle (20) and extending around the remainder of the pipe (16) to hold said cradle (20) against the pipe (16).

2. An assembly as set forth in claim 1 where said cradle (20) includes at least one substantially V-shaped member (20) having a first and second end portion (24, 26) secured to said shroud (14).

3. An assembly as set forth in claim 2 wherein said flexible member (22) is a spring (22) having a first and second ends (30, 32) removably connected to said first and second end portions (24, 26) of said V-shaped member (20), respectively.

4. An assembly as set forth in claim 3 wherein said first and second end portions (24, 26) of said V-shaped member (20) include a hole (34) therethrough, said first and second ends (30, 32) of said spring (22) being hook-shaped for removably engaging said V-shaped member (20) within said holes (34).

5. An assembly as set forth in claim 4 wherein said cradle (20) includes a pair of said V-shaped members (20).

6. An assembly as set forth in claim 2 wherein said shroud means (14) includes a central portion (36) and first and second side portions (38, 40), said first and second side portions (38) being nonparallel in relation to said central portion (36) and substantially symmetric to each other, said first and second end portions (24, 26) of said V-shaped members (20) being fixedly secured to said first and second side portions (38, 40), respectively.

7. An assembly as set forth in claim 6 wherein said central portion (36) includes an opening (42) therethrough, said fan means (12) being disposed within said opening (42).

8. An assembly as set forth in claim 7 including a substantially U-shaped support member (44) connected to said central portion (36) and spanning said opening (42), said fan means (12) being fixedly secured to said U-shaped support member (44).

9. An assembly as set forth in claim 8 including an annular support member (54) disposed about said opening (42) and secured to said U-shaped support member (44), said assembly (10) further including a screen (56) disposed over said opening (42) and including a peripheral portion about the outer circumference thereof, said peripheral portion being connected to said annular support member (54).

10. An assembly as set forth in claim 9 wherein said fan means (12) consists of a direct drive motor (48), a driven shaft (50) extending from said motor (48) and a fan member (52) secured to said shaft (50), said screen (56) being disposed between said motor (48) and said fan (52), said shaft (50) extending through said screen (56).

* * * * *